US010284978B2

(12) United States Patent
Andersen et al.

(10) Patent No.: US 10,284,978 B2
(45) Date of Patent: May 7, 2019

(54) EQUIPMENT FOR PROGRAMMING A HEARING AID AND A HEARING AID

(75) Inventors: Svend Vitting Andersen, Espergarde (DK); Lars Baekgaard Jensen, Farum (DK); Morten Kroman, Taastrup (DK)

(73) Assignee: WIDEX A/S, Lynge (DK)

( * ) Notice: Subject to any disclaimer, the term of this patent is extended or adjusted under 35 U.S.C. 154(b) by 1537 days.

(21) Appl. No.: 12/105,077

(22) Filed: Apr. 17, 2008

(65) Prior Publication Data

US 2008/0253580 A1 Oct. 16, 2008

Related U.S. Application Data

(63) Continuation-in-part of application No. PCT/DK2006/000536, filed on Sep. 29, 2006.

(30) Foreign Application Priority Data

Oct. 18, 2005 (DK) ..... 200501457
Mar. 31, 2006 (DK) ..... 200600462

(51) Int. Cl.
*H04R 29/00* (2006.01)
*H04R 25/00* (2006.01)

(52) U.S. Cl.
CPC ..... *H04R 25/70* (2013.01); *H04R 2225/41* (2013.01)

(58) Field of Classification Search
CPC ..... H04R 2225/39; H04R 2225/41; H04R 2225/55; H04R 29/002; H04R 29/008
USPC ..... 381/60, 312–321, 106
See application file for complete search history.

(56) References Cited

U.S. PATENT DOCUMENTS 4,637,402 A * 1/1987 Adelman ..... A61F 11/04 128/925
4,953,112 A * 8/1990 Widin ..... H04R 25/70 600/559
5,626,629 A * 5/1997 Faltys ..... A61N 1/36032 607/57
5,835,611 A * 11/1998 Kaiser ..... H04R 25/70 381/314
6,097,824 A * 8/2000 Lindemann ..... H04R 25/453 381/313
6,574,342 B1 6/2003 Davis
6,606,391 B2 * 8/2003 Brennan ..... H03H 17/0266 381/312

(Continued)

FOREIGN PATENT DOCUMENTS

EP 0341903 A2 11/1989
EP 0341997 A2 11/1989

(Continued)

OTHER PUBLICATIONS

Office Action for JP2008-535886 dated Jun. 7, 2011 with English translation.

(Continued)

*Primary Examiner* — Amir H Etesam
(74) *Attorney, Agent, or Firm* — Sughrue Mion, PLLC

(57) ABSTRACT

A programming equipment (1) for programming (fitting) of a programmable hearing aid (2) comprises means for receiving information on the state of operation of signal processing systems included in the hearing aid. This information is utilized to present a graphical representation of the state of operation of these systems to the person performing the programming. The invention further provides a hearing aid and a method of programming a hearing aid.

26 Claims, 3 Drawing Sheets

(56) References Cited

U.S. PATENT DOCUMENTS

| | | | | |
|---|---|---|---|---|
| 7,027,606 | B2 * | 4/2006 | D'Agri | H04R 25/70 381/312 |
| 7,054,449 | B2 * | 5/2006 | Ludi | G06F 3/04847 381/60 |
| 7,185,315 | B2 * | 2/2007 | Sharp et al. | 717/109 |
| 7,650,004 | B2 * | 1/2010 | Durant | 381/312 |
| 7,672,468 | B2 * | 3/2010 | Kaiser | H04R 25/70 381/312 |
| 8,166,312 | B2 * | 4/2012 | Waldmann | H04R 25/70 381/312 |
| 2001/0002930 | A1 * | 6/2001 | Kates | H04R 25/453 381/317 |
| 2002/0044148 | A1 | 4/2002 | Ludi | |
| 2004/0071304 | A1 * | 4/2004 | Yanz | H04R 25/70 381/312 |
| 2004/0081327 | A1 | 4/2004 | Jensen | |
| 2004/0136557 | A1 | 7/2004 | Kaulberg | |
| 2006/0023905 | A1 * | 2/2006 | Fischer | H04R 25/305 381/312 |
| 2008/0187146 | A1 * | 8/2008 | Yanz et al. | 381/60 |
| 2011/0188682 | A1 * | 8/2011 | Menzl et al. | 381/314 |

FOREIGN PATENT DOCUMENTS

| | | | |
|---|---|---|---|
| EP | 1191813 | A1 | 3/2002 |
| EP | 1441562 | A2 | 7/2004 |
| JP | 59063899 | | 4/1984 |
| JP | 05115096 | | 5/1993 |
| JP | 08317295 | | 11/1996 |
| JP | 200350392 | A | 1/2003 |
| JP | 2004509543 | A | 3/2004 |
| JP | 2004526383 | A | 8/2004 |
| WO | WO0101731 | A1 | 1/2001 |
| WO | WO 0225996 | A1 | 3/2002 |
| WO | WO 02085063 | A3 | 10/2002 |
| WO | WO2004004412 | A1 | 1/2004 |
| WO | WO2004057914 | A1 | 7/2004 |
| WO | WO2005029914 | A1 | 3/2005 |

OTHER PUBLICATIONS

Office Action for JP200853886 dated Oct. 11, 2011 with English translation.

* cited by examiner

EQUIPMENT FOR PROGRAMMING A HEARING AID AND A HEARING AID

RELATED APPLICATIONS

The present application is a continuation-in-part of application No. PCT/DK2006/000536; filed on 29 Sep. 2006, in Denmark and published as WO 2007045240, the contents of which are incorporated hereinto by reference.

BACKGROUND OF THE INVENTION

1. Field of the Invention

The present invention relates to programming equipment for the programming of a hearing aid. Such equipment is commonly known as a fitting equipment or fitting system. More specifically, the invention relates to such a system wherein information on the momentary actions of the hearing aid is transmitted to the fitting system. In addition, the present invention relates to a hearing aid adapted for interaction with such a system and a method of programming such a hearing aid.

2. The Prior Art

Modern hearing aids often include one or more highly complex signal processing systems. Examples on such signal processing systems are directional input systems, feedback cancellation systems and transposing systems. The person responsible for the adaptation of such a hearing aid to the individual user, commonly known as the fitter, faces a difficult task, since a lot of different parameters are to be coded into the hearing aid for this adaptation. This difficulty is enhanced by the fact that some of the signal processing systems applied in high-end hearing aids adapt their operation over time. Especially, during fitting to situations that the user find problematic, the fitter may be concerned that one or more of the complex signal processing systems change their state of operation during this stage of the fitting procedure and will want a way of verifying the current state of operation, in order to guide the fitter to those settings that will have an impact in the current situation.

Accordingly, there is a need for a fitting system where information on the state of operation of the hearing aid can be presented graphically to the person responsible for the fitting procedure.

SUMMARY OF THE INVENTION

The invention, in a first aspect, provides a programming equipment for the programming of a hearing aid, the hearing aid having at least a first signal processing system adapted for changing a state of operation over time, the programming equipment comprising means for reading data from the hearing aid, and means for deriving at least a first parameter representing a current state of operation of said signal processing system, means for calculating, on the basis of said first parameter, a model of said signal processing system, and means for displaying a graphical representation of the current state of operation of said signal processing system.

By providing this programming equipment, a graphical representation on the state of operation of at least one signal processing system, included in the hearing aid, may be presented to the fitter.

According to an embodiment, the hearing aid is adapted for transmitting such information to the fitting equipment.

The invention, in a second aspect, provides a hearing aid adapted for being programmed by a programming equipment, and having at least a first signal processing system adapted for changing a state of operation over time, said equipment being adapted for reading data from the hearing aid, said hearing aid being adapted for generating information on the current state of operation of said first signal processing system, in order to enable said equipment to receive the information and display a graphical representation of the current state of operation of said first signal processing system.

The invention in a third aspect, provides a method of programming a hearing aid, said hearing aid being adapted for changing a state of operation over time, the method comprising the steps of reading data from the hearing aid, coding parameters to the hearing aid, deriving information on the current state of operation of at least a first signal processing system included in the hearing aid, calculating, on the basis of the derived information, models for the current state of operation of said first signal processing system, and presenting a graphical representation of this model to the user of the programming equipment.

According to a preferred embodiment of the invention, the information presented graphically to the fitter relates to the operation of a directional system. In this way, information on which signal sources are attenuated by the directional system is available to the fitter.

According to another preferred embodiment of the invention, the information presented graphically to the fitter relates to the operation of a feedback cancellation system. In this way, information on which signal components are attenuated by the cancellation system is available to the fitter.

According to yet another preferred embodiment of the invention, the information presented graphically to the fitter relates to the operation of a transposing system. In this way, information on which signal components are added to other signal components by the transposing system is available to the fitter.

BRIEF DESCRIPTION OF THE DRAWINGS

The invention will now be described in greater detail based on non-limiting examples of preferred embodiments and with reference to the appended drawings. In the drawings.

DETAILED DESCRIPTION OF THE INVENTION

Figure 1:
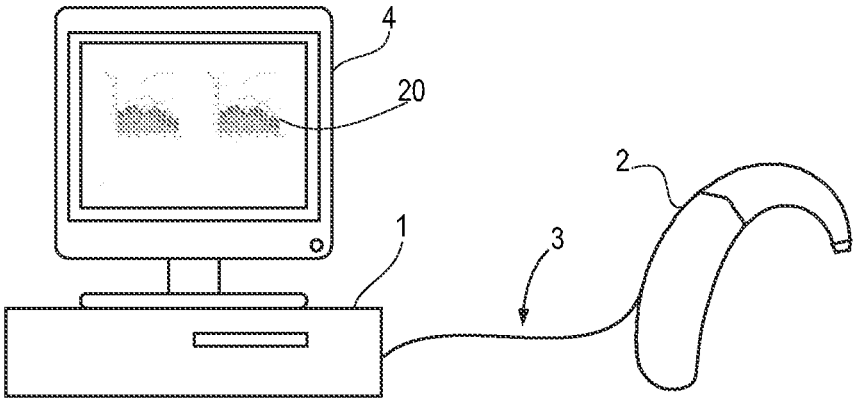
FIG. 1 illustrates a programmable hearing aid connected to programming equipment.

FIG. 1 shows a commonly known programming equipment, also known as a fitting equipment, in the form of a personal computer PC 1 adapted to the purpose. Also shown is a hearing aid 2 connected to the fitting equipment by a wired connection 3. It is well known to the skilled person that such a connection may be either wired (as shown), or wireless (not shown). Preferably, the hearing aid is mounted on the user in the ordinary position for use (not shown). The fitting equipment comprises software for reading data from the hearing aid, presenting information to the operator about the hearing aid and about the user, receiving operator input and coding parameters to the hearing aid in order to program settings controlling the operation of the hearing aid. Programming equipment per se is known from e.g. U.S. Pat. Nos. 4,901,353 and 4,989,251 (EP 341997 and EP 341903).

According to the invention, a graphical representation 20 of the state of operation of one or more signal processing systems, is presented to the fitter on the monitor 4.

Figure 2:
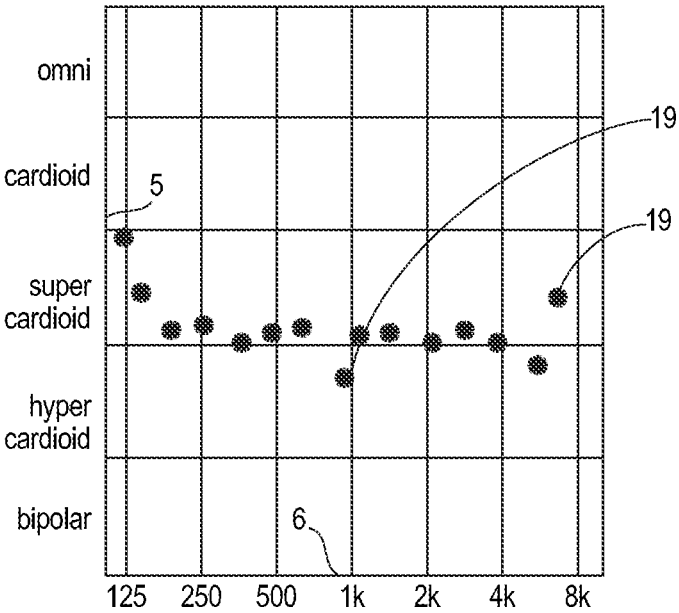
FIG. 2 illustrates a graphical representation of the state of operation of a directional system.

As shown on FIG. 2, this information may relate to a directional system. It is known, e.g. from US 2004/0081327 A1, that a hearing aid may utilize a number of so-called directional controllers, each operating adaptively in its own frequency band. In the example of FIG. 2 there are 15 frequency bands, but the skilled person will know that the number of frequency bands is merely a choice in the design of the hearing aid. By using a directional controller, e.g. of the kind known from WO 01/01731 A1, a single parameter representing the shape of the directional characteristic—in each band—may be used to calculate a model of the full directional system. WO-A-2005/029914, incorporated herein by reference, describes how a single parameter, determines the directional characteristics of the hearing aid. Preferably, this parameter is transmitted to the programming equipment via the connection 3. Transmission of such parameters is as such well known, and the skilled person will know to use an appropriate protocol such as the Digital Screwdriver (DSD) protocol developed by Etymotic Research Inc., which inter alia allows register values to be read from a hearing aid. Also, such transmission is disclosed in U.S. Pat. No. 4,989,251, also incorporated herein by reference.

The model currently in use may then be presented graphically by mapping these parameters 5 against the frequency values 6. Such a mapping could be by names as indicated in FIG. 2, by the names, "omni", "cardioid", "supercardioid", "hypercardioid", "bipolar", along the ordinate. Moreover, in addition to the mapping by names of the parameters 5 against frequency values 6, the markers 19 used preferably also convey information to the fitter. In particular by changing their shape, corresponding the mapping, i.e. by having the shape of a circular dot when the mapping is at "omni" and a shape recognizable as a cardioid when the mapping is at "cardioid", etc.

Figure 3:
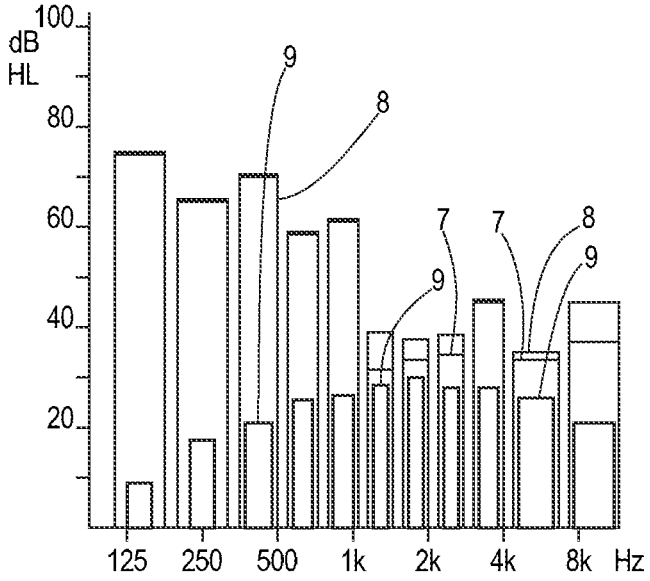
FIG. 3 illustrates a graphical representation of the state of operation of a feedback cancellation system.

As shown on FIG. 3, this information may also relate to a feedback cancelling system. It is known, e.g. from US2004/0136557 A1, that it is possible to calculate the loop-gain, i.e. the threshold at which feedback oscillation in an uncompensated system will occur. It is also known, e.g. from EP-A-1191813, to estimate the increase in the gain-margin due to the compensation system (the cancellation system). Accordingly, a good representation of the state of operation of the feedback cancellation may include, for each band, a representation of loop-gain 7, a maximum available gain 8, which is the loop-gain 7 plus the gain-margin and is referred to as "supergain", and momentary signal level 9. For the graphic representation it is thus sufficient, for each channel to transmit values for the two parameters, loop-gain and gain-margin, from the hearing aid 2 to the fitting equipment.

Figure 4:
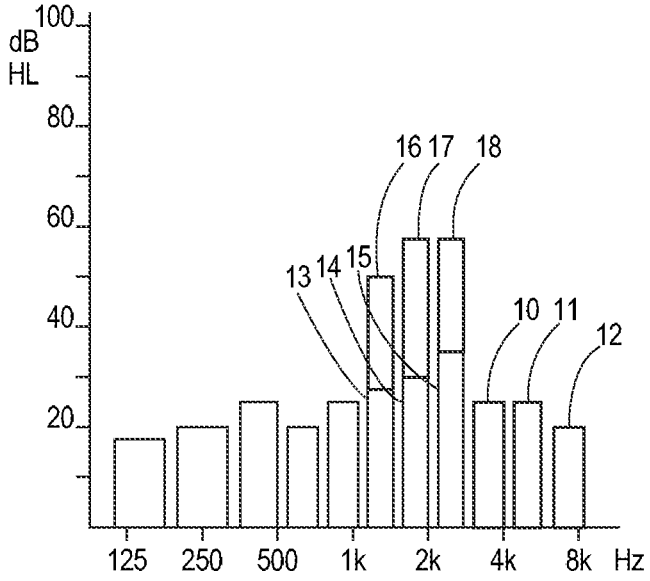
FIG. 4 illustrates a graphical representation of the state of operation of a transposing system.

It should be noted that, in order to illustrate that the number of frequency bands represented in the graphic display is merely a matter of design in the hearing aid 2 to be fitted, both FIG. 3 and FIG. 4 use representations with eleven frequency bands. As shown in FIG. 4, this information may also relate to a transposing system. It is known in the art, that such a system may be useful e.g. for treatment of severe high-frequency hearing loss. According to this technology, signal components in frequency bands with severe loss may be translated (also called transposed) to other frequency bands where the hearing loss is less severe. By the hearing aid sending information to the programming equipment about which channels are currently being transposed the transposed parts may be indicated in a way making them distinguishable from the normal signal of those bands. Accordingly, a good representation of such a system will show the mapping of signal components from bands with severe loss 10-12 onto bands with less severe loss 13-15 with an indication 16-18 of the amount of amplification applied to these signal components.

In this case the parameters to be transmitted from the hearing aid 2 to the fitting equipment would be which bands are to be shifted to which bands, and with what weight. If all of the transposed bands are to be shifted, three bands down, as in the illustrated example, a single parameter would suffice for them all, similarly a single parameter would suffice if they are all to be given the same weight after being transposed.

Figure 5:
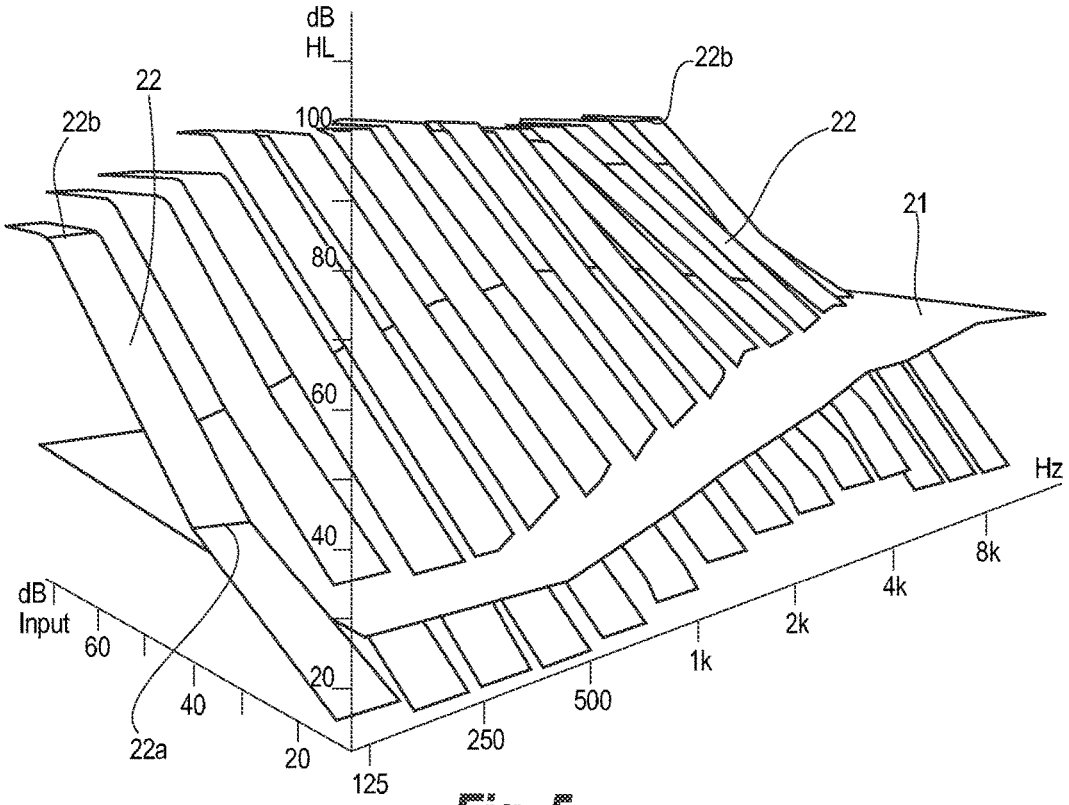
FIG. 5 illustrates a graphical representation of the state of operation of a compressor/expander system.

FIG. 5 illustrates a graphical 3D representation of the operation of a compressor/expander system of a hearing aid.

The representation has three axes. Along the abscissa is the frequency, along the ordinate is the input level to the hearing aid, and along the vertical third axis is the output level from the hearing aid.

The graphical 3D representation includes a surface 21 indicating the hearing threshold for a given hearing aid user. Intersecting the surface 21 there is a number, thirteen, of gain curves 22 for specific frequency bands of the hearing aid. The inclination of the gain curves 22 indicate different degrees of compression and/or expansion, including of cause neutral level-independent gain as well as an upper gain limit.

The parameters which are transmitted from the hearing aid 2 to the programming equipment, could be the knee points 22*a*, 22*b* and the compression or expansion ration on either side of the knee points. Thus, taking as an example the gain in the band around 125 Hz, the parameters transmitted would be the location of the knee points 22*a* and 22*b* in terms of input level. The degree of expansion below knee point 22*a*, between the knee points 22*a* and 22*b*, and the degree of expansion above the knee point 22*b*. In the example the term expansion is not to be taken literally, as below the knee point 22*a* there is in fact a compression, i.e. an expansion less than one. Between the knee points 22*a* and 22*b* the expansion is neutral b, and above the knee point 22*b* the expansion is in fact limiting.

Even though the description of the embodiments above has included the derivation, in the hearing aid, of the information on the state of operation of the relevant signal processing systems, it is within the scope of the invention to maintain, in the programming equipment, a model of the relevant signal processing systems, and to derive the relevant parameters, required to establish the graphical representation, from this model. However, this is a less preferred embodiment, since this does not enable the fitter to detect any malfunction in the relevant systems.

Apart from the above-mentioned information, sent from the hearing aid 2 to the fitting equipment, for aiding the fitter in understanding the actions of the hearing aid, other information could be sent. The skilled person will understand that information regarding other components of the hearing aid 2 could be sent. These could inter alia relate to compression functions, gain in specific frequency bands etc. The latter could occur in connection with noise suppression or speech enhancement, in which the specific frequency bands are shaped e.g. in terms of gain.

We claim:

1. A programming equipment for in-situ programming of a hearing aid worn by a hearing aid user, the hearing aid having at least one signal processing system controlling operation of said hearing aid in accordance with setting data programmed into said hearing aid during a fitting process, the programming equipment comprising:

a computer configured to read operating data from said hearing aid, said operating data including a value of at least one parameter whose value varies during operation of said hearing aid subsequent to said fitting process, and characterizing a current state of operation of at least a part of said hearing aid, and to generate modified setting data in response to said operating data and input from a hearing aid fitter;

a transmission channel by which said computer can read data from said hearing aid and write data to said hearing aid; and a monitor for providing a graphical display of said current state of operation and operation of said part of said hearing aid in accordance with said modified setting data.

2. The programming equipment according to claim 1, wherein said signal processing system is selected from a group consisting of a directional system, a feedback cancellation system, a transposing system and a compressor system.

3. The programming equipment according to claim 2, wherein said signal processing system is configured as a directional system for suppressing noise via directional patterns, said directional system operating adaptively in multiple frequency bands and having a plurality of different states of operation during operation of said hearing aid, wherein said operating data read from said hearing aid relates to said directional system and includes a parameter characterizing a current state of said signal processing system, and wherein said graphical display represents said data read from the hearing aid as a graphical representation of operation of said directional system in multiple frequency bands.

4. The programming equipment according to claim 3, wherein said data displayed is marked with respective names of different directional profiles, said names selected from a group of names comprising "omni", "cardioid", "supercardioid", "hypercardioid", and "bipolar".

5. The programming equipment according to claim 3, wherein said graphical display contains graphical markers having a shape corresponding a directional profile.

6. The programming equipment according to claim 2, wherein said signal processing system is configured as a feedback cancelling system operating adaptively in multiple frequency bands and having a plurality of different states of operation during the operation of said hearing aid, wherein said operating data read from said hearing aid relates to the feedback cancelling system and includes parameters relating to loop-gain and gain-margin, and wherein said graphical display represents said data read from said hearing aid as a graphical representation of operation of said feedback cancelling system in multiple frequency bands.

7. The programming equipment according to claim 6, wherein said data displayed includes, for each band, a representation of loop-gain, a maximum available gain, and momentary signal level.

8. The programming equipment according to claim 2, wherein said signal processing system is configured as a transposing system for moving signal components in one or more frequency bands where the wearer has severe loss to one or more frequency bands where the wearer has less severe loss, wherein said data read from said hearing aid relates to the transposing system and includes an identification of said one or more frequency bands where the wearer has severe loss and said one or more frequency bands where the wearer has less severe loss, and said graphical display represents said data read from said hearing aid as a graphical representation of the operation of said transposing system in multiple frequency bands.

9. The programming equipment according to claim 8, wherein said data read from said hearing aid includes an indication of an amount of amplification applied to said transposed frequency bands.

10. The programming equipment according to claim 2, wherein said signal processing system is configured as a compressor system ensuring that soft sounds are kept above a hearing threshold of said hearing aid user, wherein the data read from said hearing aid includes data relating to operation of said compressor system, including an identification of at least one knee point and a compression or expansion ratio on either side of said at least one knee point, and wherein said graphical display is a graphical 3D representation of the operation of said compressor system with three axes representing the frequency, the input level to the hearing aid, and the output level from the hearing aid respectively.

11. A method of programming a hearing aid while being worn by a hearing aid user, said hearing aid having at least one signal processing system controlling operation of said hearing aid in accordance with setting data programmed into said hearing aid by a fitting process, said method comprising the steps of:

reading operating data from said hearing aid, said operating data including a value of at least one parameter whose value varies during operation of said hearing aid subsequent to said fitting process and characterizing a current state of operation of at least a part of said hearing aid, generating modified setting data in response to said operating data read from said hearing aid and input from a hearing aid fitter; and presenting a graphical display of said current state of operation and operation of said part of said hearing aid in accordance with said modified setting data.

12. The method according to claim 11, wherein said signal processing system is selected from a group consisting of a directional system, a feedback cancellation system, a transposing system and a compressor system.

13. The method according to claim 12, wherein said signal processing system is configured as a directional system for suppressing noise via directional patterns, said directional system operating adaptively in multiple frequency bands and having a plurality of different states of operation during operation of said hearing aid, wherein said operating data read from said hearing aid relates to said directional system and includes a parameter characterizing a current state of said signal processing system, and wherein said graphical display represents said data read from the hearing aid as a graphical representation of operation of said directional system in multiple frequency bands.

14. The method according to claim 13, wherein said data displayed is marked with respective names of different directional profiles, said names selected from a group of names comprising "omni", "cardioid", "supercardioid", "hypercardioid", and "bipolar".

15. The method according to claim 13, wherein said graphical display contains graphical markers having a shape corresponding a directional profile.

16. The method according to claim 12, wherein said signal processing system is configured as a feedback cancelling system operating adaptively in multiple frequency bands and having a plurality of different states of operation during the operation of said hearing aid, wherein said operating data read from said hearing aid relates to the feedback cancelling system and includes parameters relating to loop-gain and gain-margin, and wherein said graphical display represents said data read from said hearing aid as a graphical representation of operation of said feedback cancelling system in multiple frequency bands.

17. The method according to claim 16, wherein said data displayed includes, for each band, a representation of loop-gain, a maximum available gain, and momentary signal level.

18. The method according to claim 12, wherein said signal processing system is configured as a transposing system for moving signal components in one or more frequency bands where the wearer has severe loss to one or more frequency bands where the wearer has less severe loss, wherein said data read from said hearing aid relates to the transposing system and includes an identification of said one or more frequency bands where the wearer has severe loss and said one or more frequency bands where the wearer has less severe loss, and said graphical display represents said data read from said hearing aid as a graphical representation of the operation of said transposing system in multiple frequency bands.

19. The method according to claim 18, wherein said data read from said hearing aid includes an indication of an amount of amplification applied to said transposed frequency bands.

20. The method according to claim 12, wherein said signal processing system is configured as a compressor system ensuring that soft sounds are kept above a hearing threshold of said hearing aid user, wherein the data read from said hearing aid includes data relating to operation of said compressor system, including an identification of at least one knee point and a compression or expansion ratio on either side of said at least one knee point, and wherein said graphical display is a graphical 3D representation of the operation of said compressor system with three axes representing the frequency, the input level to the hearing aid, and the output level from the hearing aid respectively.

21. A non-transitory computer-readable storage medium storing thereon computer-executable instructions, which, when executed on a programming computer connected to a hearing aid during fitting, cause to be performed a method wherein a fitter fits said hearing aid to a user, said hearing aid having at least one signal processing system controlling operation of said hearing aid in accordance with setting data programmed into said hearing aid by a fitting process, wherein said method includes the following steps performed by said programming computer:

reading operating data from said hearing aid, said operating data including a value of at least one parameter whose value varies during operation of said hearing aid subsequent to said fitting process and characterizing a current state of operation of at least a part of said hearing aid, generating modified setting data in response to said operating data read from said hearing aid and input from said fitter; and presenting a graphical display of said current state of operation and operation of said part of said hearing aid in accordance with said modified setting data.

22. The programming equipment according to claim 1, wherein said value of said at least one parameter at the time it is read from said hearing aid by said computer cannot be determined alone from data that has been programmed into said hearing aid from an external source.

23. The method according to claim 11, wherein said value of said at least one parameter at the time it is read from said hearing aid by said computer cannot be determined alone from data that has been programmed into said hearing aid from an external source.

24. The non-transitory computer readable storage medium of claim 21, wherein said value of said at least one parameter at the time it is read from said hearing aid by said computer cannot be determined alone from data that has been programmed into said hearing aid from an external source.

25. The programming equipment according to claim 3, wherein:

said signal processing system is also configured as a feedback cancelling system operating adaptively in multiple frequency bands and having a plurality of different states of operation during the operation of said hearing aid, wherein said operating data read from said hearing aid relates to the feedback cancelling system and includes parameters relating to loop-gain and gain-margin, and wherein said graphical display represents said data read from said hearing aid as a graphical representation of operation of said feedback cancelling system in multiple frequency bands, and wherein said data displayed includes, for each band, a representation of loop-gain, a maximum available gain, and momentary signal level; and said signal processing system is also configured as a transposing system for moving signal components in one or more frequency bands where the wearer has severe loss to one or more frequency bands where the wearer has less severe loss, wherein said data read from said hearing aid relates to the transposing system and includes an identification of said one or more frequency bands where the wearer has severe loss and said one or more frequency bands where the wearer has less severe loss, and said graphical display represents said data read from said hearing aid as a graphical representation of the operation of said transposing system in multiple frequency bands, and said data read from said hearing aid includes an indication of an amount of amplification applied to said transposed frequency bands.

26. The method according to claim 13, wherein:

said signal processing system is also configured as a feedback cancelling system operating adaptively in multiple frequency bands and having a plurality of different states of operation during the operation of said hearing aid, wherein said operating data read from said hearing aid relates to the feedback cancelling system and includes parameters relating to loop-gain and gain-margin, and wherein said graphical display represents said data read from said hearing aid as a graphical representation of operation of said feedback cancelling system in multiple frequency bands, and said data displayed includes, for each band, a representation of loop-gain, a maximum available gain, and momentary signal level; and said signal processing system is also configured as a transposing system for moving signal components in one or more frequency bands where the wearer has severe loss to one or more frequency bands where the wearer has less severe loss, wherein said data read from said hearing aid relates to the transposing system and includes an identification of said one or more frequency bands where the wearer has severe loss and said one or more frequency bands where the wearer has less severe loss, and said graphical display represents said data read from said hearing aid as a graphical representation of the operation of said transposing system in multiple frequency bands, and said data read from said hearing aid includes an indication of an amount of amplification applied to said transposed frequency bands.

* * * * *